United States Patent [19]

Kohara

[11] Patent Number: 4,700,523

[45] Date of Patent: Oct. 20, 1987

[54] REINFORCING FRAME WORK FOR CONSTRUCTING REINFORCED CONCRETE STRUCTURE

[75] Inventor: Soichiro Kohara, Saitama, Japan

[73] Assignee: Fujikigyo Co., Ltd., Japan

[21] Appl. No.: 813,664

[22] Filed: Dec. 26, 1985

[30] Foreign Application Priority Data

Dec. 28, 1984 [JP] Japan ..... 59-278679

[51] Int. Cl.[4] ..... E04B 2/00

[52] U.S. Cl. ..... 52/565; 52/431; 52/426; 52/563

[58] Field of Search ..... 52/425, 426, 427, 664, 52/600, 569, 570, 571, 572, 431

[56] References Cited

U.S. PATENT DOCUMENTS

| | | | |
|---|---|---|---|
| 1,014,416 | 1/1912 | Schweikert | 52/425 |
| 1,334,672 | 3/1920 | Noullet | 52/425 |
| 3,676,967 | 7/1972 | Frati | 52/426 |
| 3,744,202 | 7/1973 | Hubmann | 52/600 |
| 4,133,156 | 1/1979 | Unger | 52/426 |
| 4,433,520 | 2/1984 | Maschhoff | 52/426 |

FOREIGN PATENT DOCUMENTS

| | | | |
|---|---|---|---|
| 2249219 | 6/1975 | France | 52/600 |
| 330391 | 6/1958 | Switzerland | 52/426 |

*Primary Examiner*—Henry E. Raduazo

[57] ABSTRACT

A reinforcing frame work for covering structural steel bars of a reinforced concrete structure to be constructed is disclosed herein. The frame work comprises a plurality of frame units connected together and disposed along said structural steel bars, each of said frame units comprising a plurality of spacers extending in the transverse direction of said concrete structure and at least one guide steel bar extending in the longitudinal direction of said concrete structure and having said spacers secured thereto in laterally spaced relationship along the length of the guide steel bar.

2 Claims, 20 Drawing Figures

REINFORCING FRAME WORK FOR CONSTRUCTING REINFORCED CONCRETE STRUCTURE

BACKGROUND OF THE INVENTION

This invention relates to reinforcing frame works for constructing reinforced concrete structures together with conventional inner and outer wall members and/or inner and outer insulation and lathing.

In constructing a reinforced concrete structure, the prior art methods required temporary frame and mould fabrication operations for placing concrete. Thus, the assembling and disassembling of the temporary frames and/or moulds are essential in the concrete placing operation and account for a substantial portion of the concrete placing operation. And after the concrete placing, inner and outer lathing and installation and inner and outer finish facing installation have been conventionally performed. More particularly, when insulation and lathing and/or specific wall facing installation operations are involved, the construction operation of a reinforced concrete structure is quite inefficient and expensive.

In addition, even when inner and outer facing wall materials are used as disposable moulds in concrete placing, the operation is performed in a manner similar to the moulding operation and the construction operation of a reinforced concrete structure is inefficient, expensive and uneconomical.

SUMMARY OF THE INVENTION

Thus, the purpose of the present invention is to provide a reinforcing frame work for constructing a reinforced concrete structure together with inner and outer wall members and/or inner and outer insulation and lathing without temporary framing and/or moulding operations.

In order to attain the purpose, according to the present invention, spacers are oriented in the transverse direction of a reinforced concrete structure to be constructed, guide steel bars are secured to the spacers to form a reinforcing frame work, inner and outer wall members and/or inner and outer insulation and lathing are placed in the frame work in the longitudinal direction of the reinforced concrete structure to be constructed and concrete is placed in predetermined positions within the concrete structure to be constructed.

The present invention is featured that in order to construct a reinforced concrete structure on the spot of the construction of the concrete structure without conventional temporary framing operation as described in the co-pending Japanese patent application No. 133322/1982, the guiding position of the spacers of the reinforcing frame work as shown in Japanese patent application No. 128632/1984 is altered and the holding-down way of the wall facings (inner and outer wall members and/or insulation and lathing) is improved to thereby obtain a reinforced concrete structure having the wall facings integrally incorporated therein positively and effectively.

Various embodiments of the reinforcing frame works of the present invention which will be described hereinbelow referring to the accompanying drawings can be selectively employed depending upon the type of a reinforced concrete structure to be constructed.

Each of the embodiments is designed to stand the thickness or mass of a concrete layer placed and the insulation and lathing and/or outer and inner wall members incorporated in or attached to the frame work are secured together by the hook portions of spacers and guide steel bars and/or inner and outer wall members are designed to prevent placed concrete from flowing out.

The present invention is further featured that without conventional moulding and the like operation, when a reinforced concrete structure and more particularly, a concrete wall requires lathing of inner and outer facings, inner and outer insulation and/or inner and outer facing finish, a plurality of the inventive preformed reinforcing frame works are arranged and secured together and then concrete is placed to thereby construct a reinforced concrete structure having inner and outer wall members and/or inner and outer insulation and lathing effectively at less expense in a short period of time.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same.

PREFERRED EMBODIMENTS OF THE INVENTION

Figure 1:
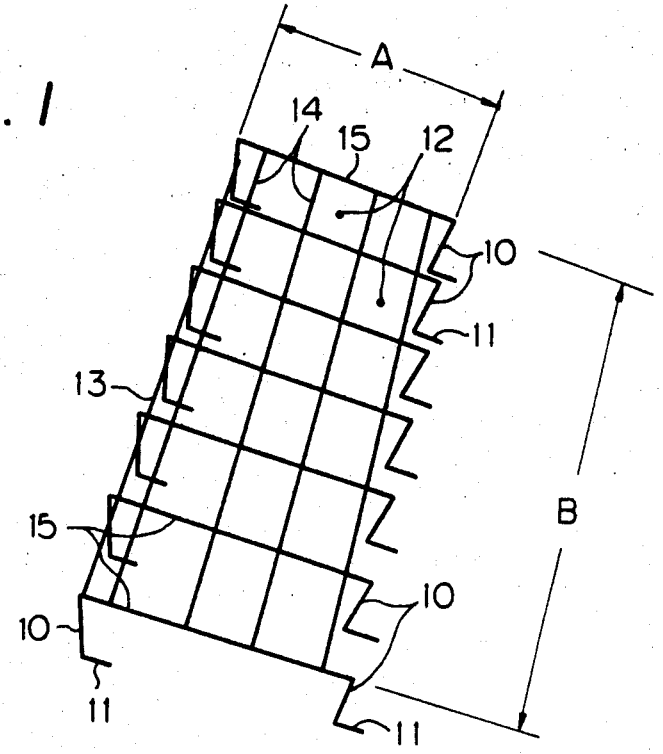
FIG. 1 is a fragmentary perspective view of a first stage of the reinforcing frame work constructed according to the present invention.
Figure 2:
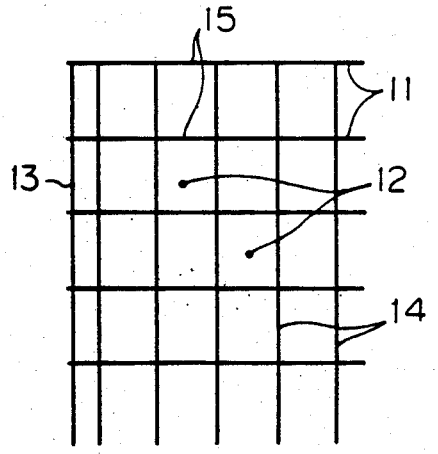
FIG. 2 is a plan view of FIG. 1.
Figure 3:
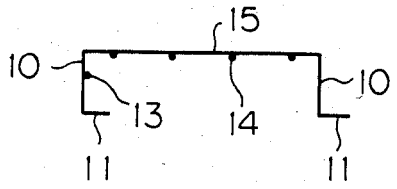
FIG. 3 is a side elevational view as seen in the dimensional direction A of FIG. 1.
Figure 4:
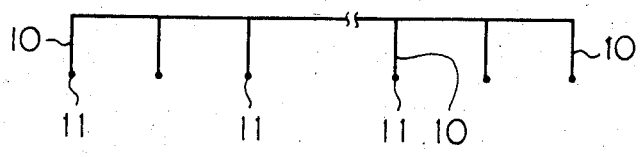
FIG. 4 is a side elevational view as seen in the dimensional direction B of FIG. 1.

Referring now to the accompanying drawings and more particularly, to FIGS. 1 to 7 inclusive which show the first embodiment of the reinforcing frame work constructed in accordance with the present invention. The reinforcing frame work generally comprises a plurality of vertical reinforcing steel bars 14 and a plurality of horizontal reinforcing steel bars or spacers 15. Each of the horizontal reinforcing steel bars or spacers 15 includes a spacer portion 10 and a hook portion 11 integral with the spacer portion at each of the opposite ends of the steel bar 15. The hook portion 11 at one end of the steel bar 15 is bent inwardly whilst the hook portion 11 at the other end is bent outwardly. However, the shape of the reinforcing steel bar or spacer 15 is not limited to such a shape. The length of the central spacer portion 10 may vary depending upon the extension in the width direction (thickness) of the reinforced concrete structure to be constructed. As more clearly shown in FIG. 6, the vertical and horizontal reinforcing steel bars 14, 15 are secured to the outer sides of opposing and spaced wall members and the hook portions 11 of the opposing and spaced parallel spacers 15 are connected together through guide steel bars 16 to hold the obtained frame work in its assembled position. Reference numeral 12 denote mesh areas which are adapted to prevent the frame work from breaking under the pressure of concrete placing and dimensions of the mesh area may vary depending upon the type of the inner and outer insulation and lathing. Reference numeral 13 denotes auxiliary reinforcing steel bars, reference numerals 20, 21 denote structural steel bars of the reinforced concrete structure to be constructed and reference numeral 40 denotes the thickness of the protective concrete coverings.

Figure 5:
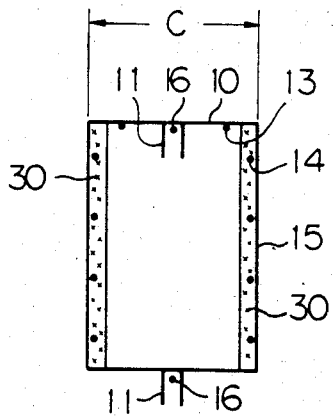
FIG. 5 is a sectional view illustrating in elevation a further stage of the construction and showing the connection between the components of the reinforcing frame work of the invention wherein two opposing and spaced parallel frame works each having insulation and lathing fitted therein are assembled by securing the hook portions of the spacers to the guide steel bars.

Referring to FIG. 5, reference character C denotes the total thickness of the reinforced concrete structure to be constructed (the outer insulation and lathing+concrete layer+inner insulation and lathing).

Figure 6:
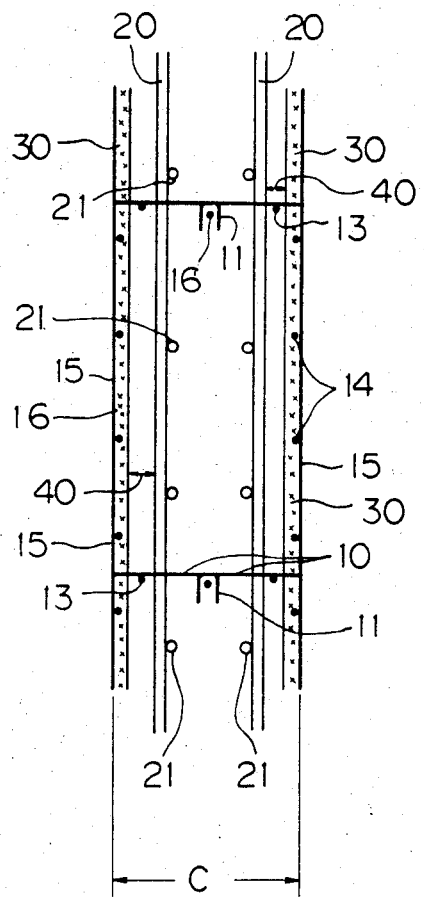
FIG. 6 is a schematic elevational view a still later stage of construction showing a wall of a reinforced concrete building to be constructed in which the frame works having the insulation and lathing fitted therein assembled as shown in FIG. 5 are connected to two opposing and spaced parallel structural steel bars of a reinforced concrete structure to be constructed.
Figure 8:
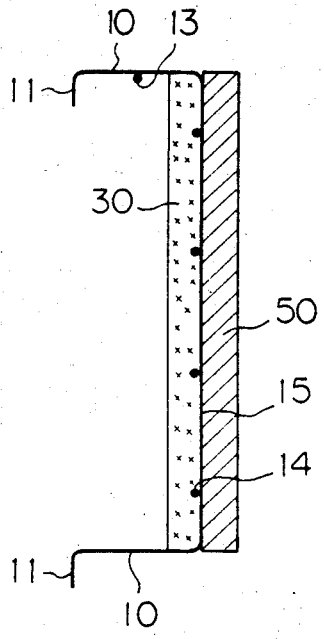
FIG. 8 is a sectional view of one portion of the structure illustrated in FIG. 5 to which has been added a secondary wall element, this view illustrating only one-half section of the elevational section of FIG. 5.

Turning to FIG. 6, insulation and lathing 30 are fitted in the opposing and spaced structural steel bars 20, 21 of the reinforced concrete structure to be constructed and the above-mentioned components are connected and assembled together to provide the reinforced frame wall structure as shown in FIG. 5.

Figure 7:
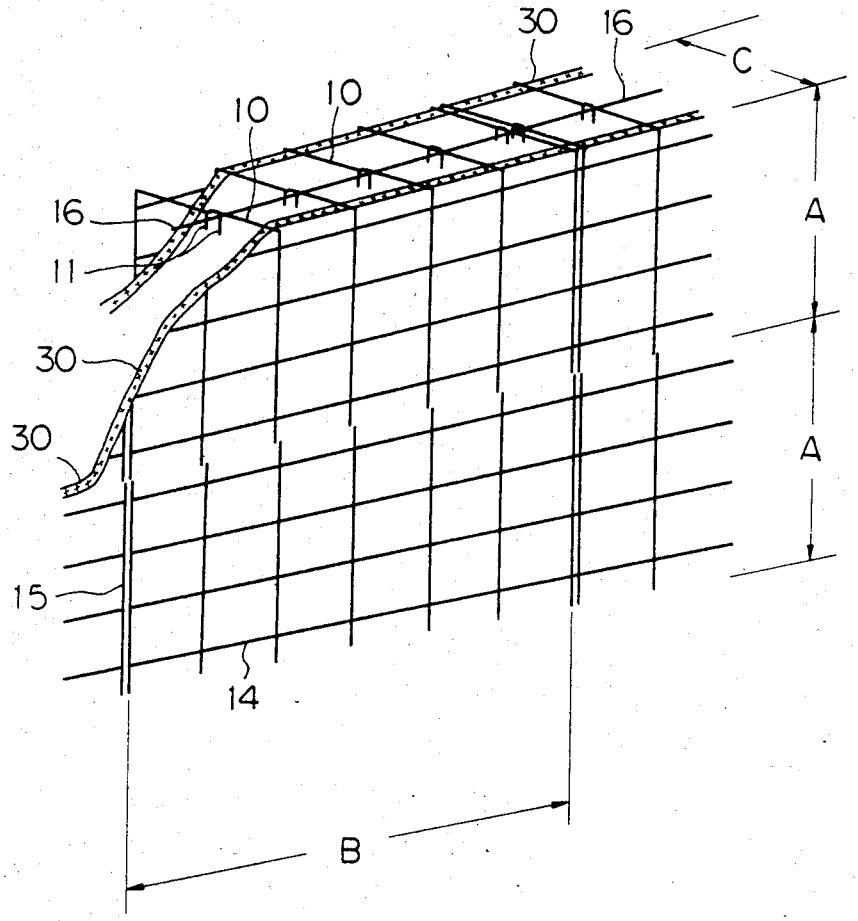
FIG. 7 is a perspective view of the wall formed as shown in FIG. 6 except for the ommission of the structural reinforcing bars in that view.
Figure 9:
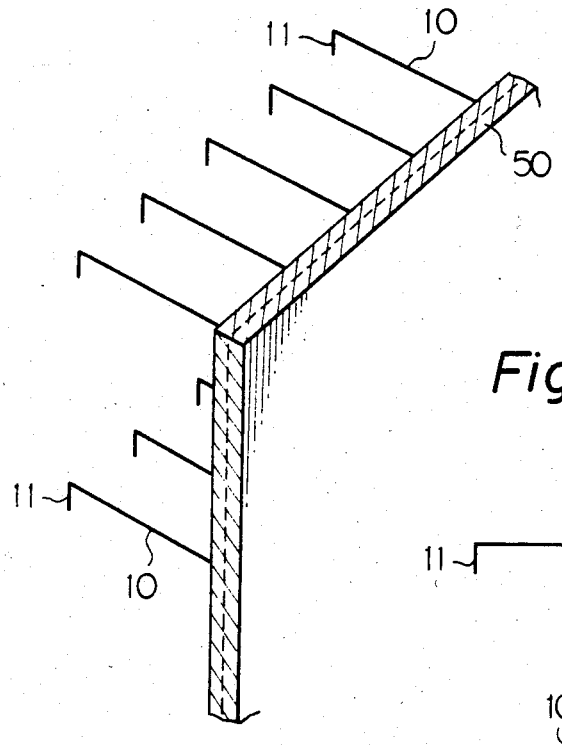
FIG. 9 is a perspective view of a wall member having spacers embodying the present invention.
Figure 10:
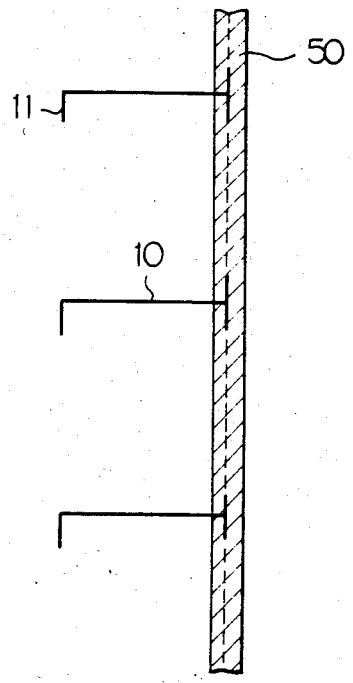
FIG. 10 is a sectional view of FIG. 9.

FIG. 7 shows a portion of the obtained reinforced concrete building incorporating the reinforced concrete structure with the structural steel bars removed therefrom.

The auxiliary reinforcing steel bars 13 are optional, but not an essential component.

The horizontal steel bars 14 serve to reinforce the horizontal reinforcing steel bars or spacers 15 and also to hold inner and outer insulation and lathing in cooperation with the vertical steel bars 15.

In the illustrated embodiment, although the horizontal reinforcing steel bars or spacers 15 have the spacer and hook portions 10, 11, the spacer and hook portions may be formed separate from the horizontal steel bars 15 provided that the reinforcing frame work can stand against concrete placing pressure.

In the illustrated embodiment, the guide steel bars 16 are necessary in the assembling of the reinforcing frame work of the invention, the structural steel bars of the reinforced concrete structure itself can be also used as the guide steel bars.

The insulation and lathing 30 are necessary for constructing the reinforced concrete structure without the utilization of temporary frame and/or mould fabrication operations and the type of the insulation and lathing can be operationally selected depending upon the application of the walls of the reinforced concrete structure to be constructed. In addition, the insulation and lathing may be formed of a simple member or complex member of styrene and coarse mesh, for example.

In the illustrated embodiment, although A indicates the vertical dimension of the reinforcing frame work and B indicates the horizontal dimension of the frame work, the dimensions may be optionally selected to expedite the assembling of the rectangular frame work as shown or to meet conditions and dimensions of the reinforced concrete structure to be constructed.

Figure 11:
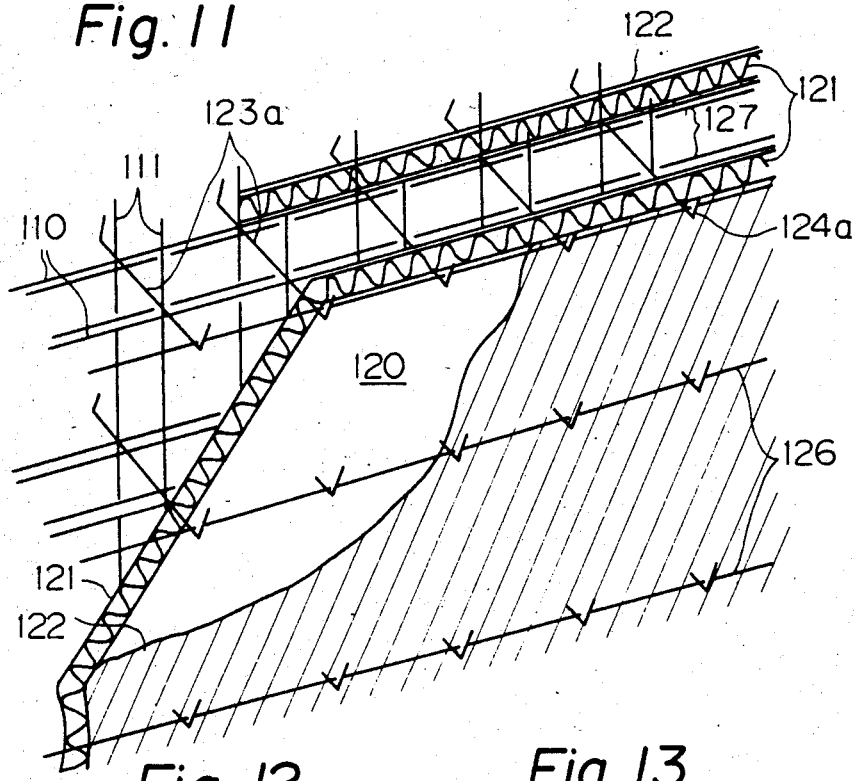
FIG. 11 is a fragmentary perspective view of a reinforced concrete structure in which a second embodiment of the reinforcing frame work according to the present invention is incorporated.

FIG. 11 is a fragmentary perspective view of a reinforced concrete structure which is in the form of a building wall 120 having modified reinforcing frame works of the invention incorporated therein. The building wall 120 generally comprises two opposing and spaced parallel wall members each comprising a board 121 and a plurality of steel bars 122 secured to the outer surface of the board 121. A modified reinforcing frame work according to the present invention is interposed between the wall members. The modified reinforcing frame work comprises a plurality of spacers 123 extending between the wall members in laterally spaced relationship to each other in the longitudinal direction of the wall and a plurality of guide steel bars 127 to which the spacers 123 are secured (see FIGS. 11 to 13 inclusive).

Different embodiments of spacers are shown in FIGS. 14*a*, 14*b*, 14*c*, 14*d* and 14*e*.

Figure 14:
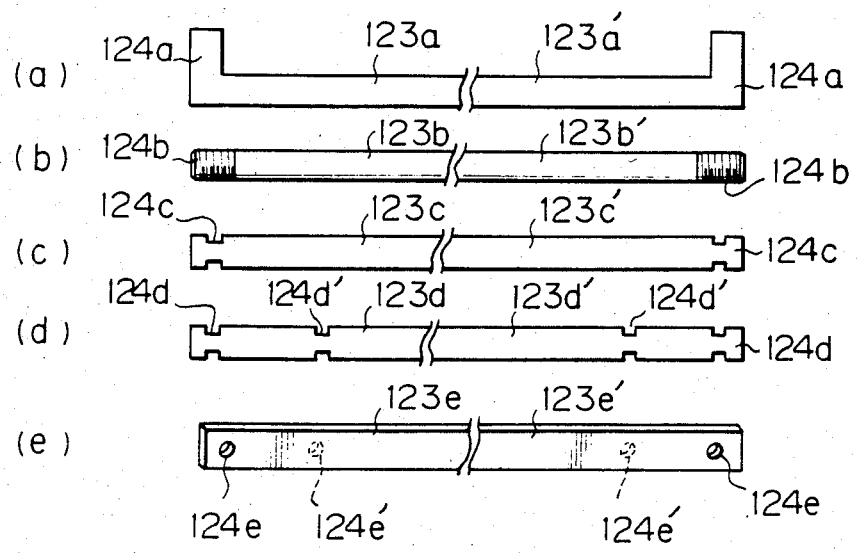
FIGS. 14*a*–14*e* are side elevational views of different embodiments of spacers which are the components of the reinforcing frame work of the invention.

The spacer 123*a* of FIG. 14*a* is formed of a length of round steel bar and comprises a central spacer portion 123*a*′ and hook portions 124*a* formed at the opposite ends of the spacer portion and extending upwardly from the spacer portion at right angles thereto. In the reinforced building shown in FIG. 11, a plurality of the spacers 123*a* are so disposed that the hook portions 124*a*′ of the spacers extend through the two wall members to the exterior thereof and support the retaining steel bars 126. The hook portions 124*a* serve to maintain a predetermined space between the two wall members whilst the retaining steel bars 126 serve to retain the steel bars 122.

Figure 12:
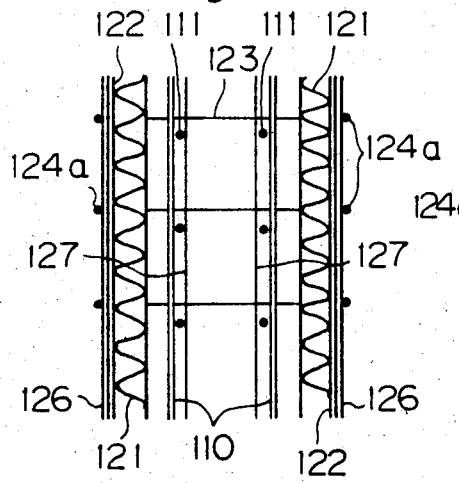
FIG. 12 is a plan view of a portion of FIG. 1.
Figure 13:
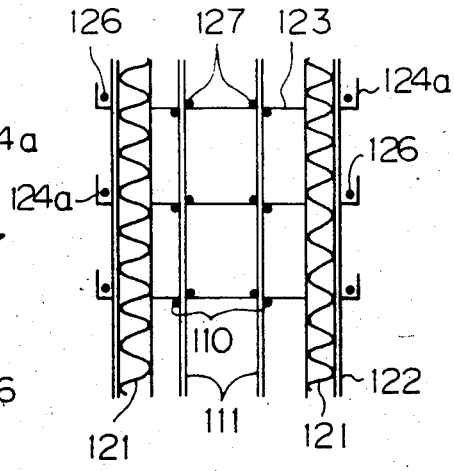
FIG. 13 is an elevational view of a portion of FIG. 11.

In FIGS. 11 to 13 inclusive, reference numerals 110 and 111 denote the horizontal and vertical steel bars of the modified reinforcing frame work which correspond to the horizontal and vertical steel bars in the fist embodiment of the reinforcing frame work, respectively.

The spacer 123*b* of FIG. 14*b* comprises a central spacer portion 123*b'* and threaded hook portions 124*b* at the opposite ends of the spacer portion 123*b'*. The spacer 123*b* is secured to the wall members by means of nuts (not shown) screwed on the hook portions. The spacer 123*c* of FIG. 14*c* comprises a central spacer portion 123*c'* and hook portions 124*c* in the shape of a recess formed adjacent to the opposite ends of the spacer portion 123*c*. The spacer 123*d'* of FIG. 14*d* comprises a spacer portion 123*d'*, hook portions 124*d* formed at the opposite ends of the spacer portion 123*d'* and additional hook portions 124*d'* formed in the spacer portion 123*d'* inwardly of the hook portions 124*d*. The spacer 123*e* of FIG. 14*e* is formed of a length of band steel and comprises a spacer portion 123*e'* and hook portions 124*e* at the opposite ends of the spacer portion 123*e'* and additional hook portions 124*e'* formed in the spacer portion 123*e'* inwardly of the hook portions 124*e*. The hook portions 124*e* and 124*e'* are in the form of a through hole. The type of the hook portions are selected depending upon the type of the building wall to be constructed and environmental conditions of the site of construction.

Figure 15:
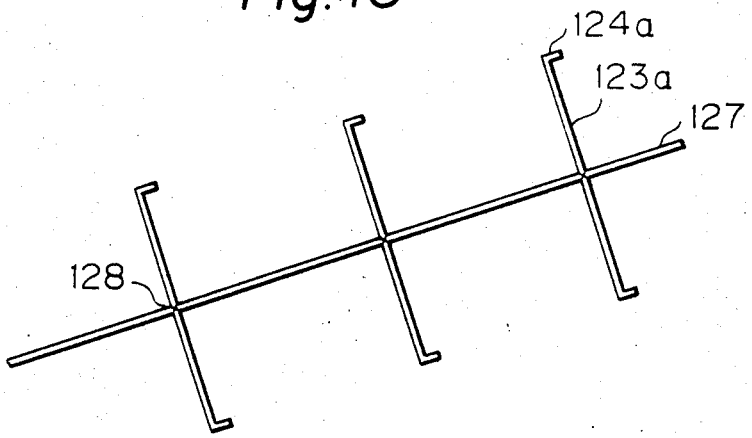
FIG. 15 is a fragmentary plan view showing the connection between spacers and a common guide steel bar in a single type spacer - guide steel bar assembly.
Figure 16:
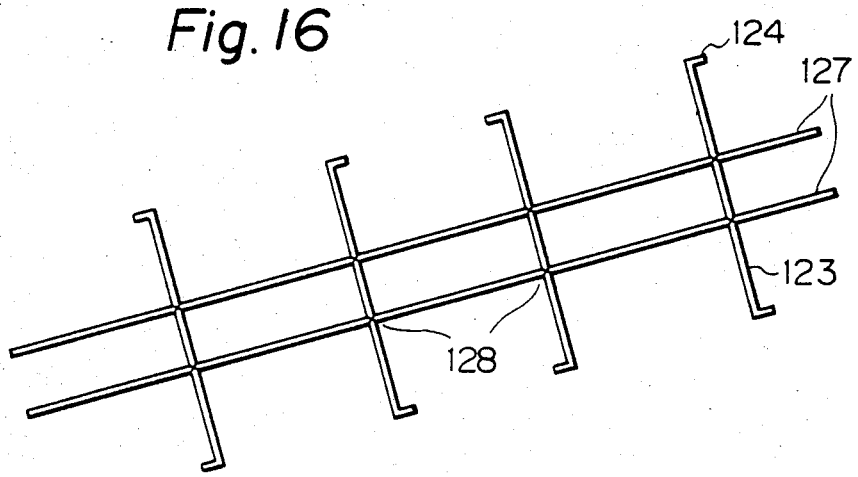
FIG. 16 is a fragmentary plan view showing the connection between spacers and two guide steel bars in a double type spacer - guide steel bar assembly.

FIG. 15 shows a spacer and guide steel assembly which is generally called as a single type assembly and comprises a single or common guide steel bar 127 and a plurality of spacers 123 in laterally spaced relationship secured to the guide steel bar along the length of the bar by means of welding 128, for example. FIG. 16 shows a modified spacer and guide steel bar assembly which is generally called as a double type and comprises two opposing and spaced parallel guide steel bars 127 and a plurality of spacers 123 secured in laterally spaced relationship to the two guide steel bars 127 along the length of the respectively associated guide steel bars by means of welding 128, for example.

Figure 17:
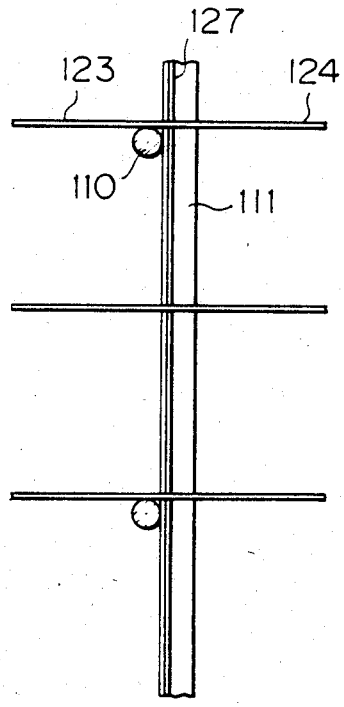
FIG. 17 is an elevational view of an application in which the single type spacer - guide steel bar is oriented vertically.
Figure 18:
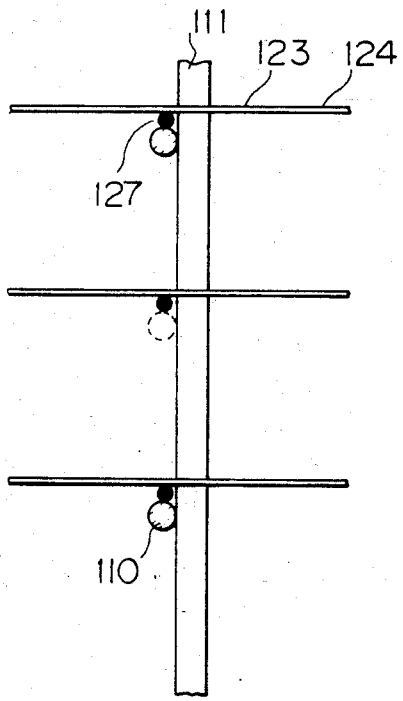
FIG. 18 is a fragmentary elevational view of an application in which the single type spacer - guide steel bar assembly is oriented horizontally.

FIG. 17 shows an application of the single type spacer - guide steel bar assembly wherein the assembly is oriented vertically and FIG. 18 shows an application of the single type spacer - guide steel bar assembly wherein the assembly is oriented horizontally.

Figure 19:
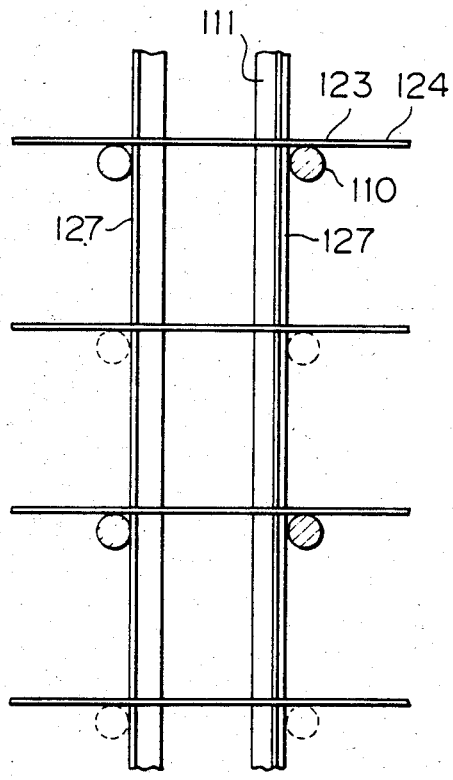
FIG. 19 is a fragmentary elevational view of an application in which the double type spacer - guide steel bar assembly is oriented vertically.
Figure 20:
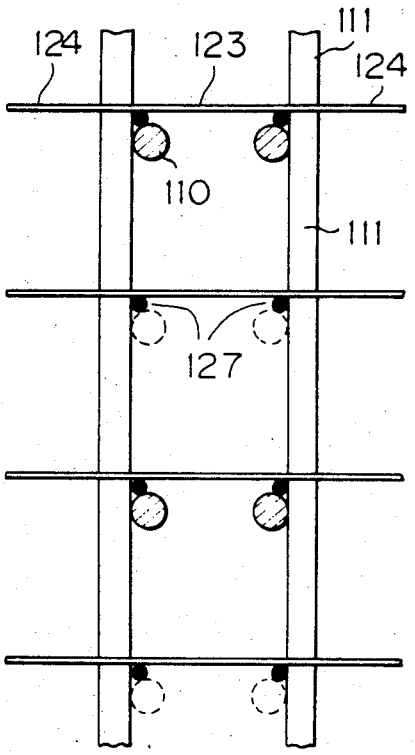
FIG. 20 is a fragmentary elevational view of an application in which the double type spacer - guide steel bar assembly is oriented horizontally.

FIG. 18 shows an application of the double type spacer - guide steel bar assembly in which the double type assembly is oriented vertically and FIG. 19 shows an application of the double type spacer - guide steel assemble in which the double type assembly is oriented horizontally.

The selection of the single or double type spacer-guide steel bar assembly is determined depending upon the arrangement of the structural steel bars of a reinforced concrete structure to be constructed.

The guide steel bars 127 extend in the longitudinal direction of the wall members and all the spacers 123 are secured to the guide steel bars. When the spacers are secured to the guide steel bars, the spacers can be more easily and precisely incorporated in the associated structural wall as compared with when the spacers are separately incorporated in the wall.

The reinforcing frame works of the present invention can be quite simply assembled and provide the following effects:

(1) When the spacers are secured to the guide steel bar or bars, the spacers are prevented from displacing individually.

(2) When the spacers are secured to the guide steel bar or bars, the spacers can be efficiently incorporated into or attached to the structural steel bars.

(3) When the spacers are secured to the guide steel bar or bars and structural steel bars, rows of the structural steel bars are stabilized.

(4) When the spacers are formed at the opposite ends thereof with the hook portions and support the wall insulation and lathing of a reinforced concrete structure or the like, concrete can be placed without the necessity of temporary frame fabrication operation.

(5) The hook portions at the opposite ends of the spacers serve to firmly secure the spacers to the facing materials of a reinforced concrete structure (insulation and lathing, for example), and thus, the separation and/or fall of the wall facing materials can be prevented and reliance of the spacers is enhanced.

While the present invention has been particularly shown and described with reference to the preferred embodiments thereof, it will be understood by those skilled in the art that various changes in form and details may be made herein without departing from the spirit and scope of the invention.

What is claimed is:

1. A frame work for use in constructing a steel reinforced concrete wall structure and comprising; laterally spaced inner and outer wall elements (30, 30) of light weight insulating board material, said wall elements arranged parallel to one another and extending longitudinally to define a wall of length B, and extending vertically to define a wall height equal to an even multiple of height A, and having outer surfaces that are so spaced from one another as to define a wall thickness C, longitudinally extending steel bar elements (14, 14) provided adjacent the outer surface of said wall elements, said bar elements being arranged generally parallel to one another, longitudinally spaced steel frame units also provided adjacent the outer surfaces of said wall elements and cooperating with said steel bar elements to define an open grid, each frame unit including at least two oppositely disposed generally U-shaped steel frame unit defining elements (15, 15) each said frame element having leg portions (10, 10) of length equal to or greater than C/2, said leg portions spaced vertically by a dimension A each frame element having an elongated base portion that is provided adjacent said wall element outer surface, each frame element leg portion having an end portion defining a down-turned hook (11, 11), said leg end portions of said two frame unit defining elements overlapping one another intermediate said wall elements, and longitudinally extending steel guide bars (16, 16) secured at longitudinally spaced locations to said overlapped leg end portions.

2. The frame work of claim 1 wherein said frame elements comprise steel wire bent to said U-shape and having leg end portions that define said hook portions.

* * * * *